United States Patent [19]

Moote et al.

[11] 4,412,913

[45] Nov. 1, 1983

[54] USE OF ALKANOLAMINES IN SWEETENING SOUR LIQUID HYDROCARBON STREAMS

[75] Inventors: Truman P. Moote; Myron L. Dunton, both of Tulsa; Russell L. McGalliard, Broken Arrow, all of Okla.; Lyman Yarborough, Kingwood, Tex.

[73] Assignee: Standard Oil Company (Indiana), Chicago, Ill.

[21] Appl. No.: 405,493

[22] Filed: Aug. 5, 1982

[51] Int. Cl.[3] ..... C10G 29/02

[52] U.S. Cl. ..... 208/207

[58] Field of Search ..... 208/207

[56] References Cited

U.S. PATENT DOCUMENTS

| | | | |
|---|---|---|---|
| 2,882,224 | 4/1959 | Gleim et al. | 208/207 |
| 2,978,404 | 4/1961 | Bowers | 208/207 |
| 4,070,271 | 1/1978 | Carlson et al. | 208/206 |
| 4,124,494 | 11/1978 | Frame | 208/207 |
| 4,127,474 | 11/1978 | Frame | 208/207 |
| 4,141,819 | 2/1979 | Carlson | 208/207 |

FOREIGN PATENT DOCUMENTS

| | | | |
|---|---|---|---|
| 513069 | 5/1976 | U.S.S.R. | 208/207 |

*Primary Examiner*—Delbert E. Gantz
*Assistant Examiner*—Cynthia A. Prezlock

[57] ABSTRACT

A method is described by which sour liquid hydrocarbon streams are sweetened by subjecting said streams to oxidizing conditions in the presence of a hydrocarbon soluble alkanolamine.

7 Claims, 3 Drawing Figures

METHYL MERCAPTAN REMOVED FROM NATURAL GAS LIQUIDS BY OXIDATION TO THE DISULFIDES IN THE PRESENCE OF DIETHANOLAMINE AND AIR

| SYMBOL | AIR PRESSURE PSIA | EXT'N TEMP °F | RATIO: PENTANE/ 30 WT% DEA | CATALYST |
|---|---|---|---|---|
| □ | NONE | 125 | 5/1 | NONE |
| ▲ | 15 | 75 | 5/1 | NONE |
| △ | 15 | 125 | 5/1 | NONE |
| ■ | 15 | 125 | 5/1 | NONE |
| ○ | 30 | 125 | 5/1 | NONE |
| × | 30 | 125 | 5/1 | 0.073 GM Co 100 ML/30 WT% DEA |

ETHYL MERCAPTAN REMOVED FROM NATURAL GAS LIQUIDS BY OXIDATION TO THE DISULFIDES IN THE PRESENCE OF DIETHANOLAMINE AND AIR

| SYMBOL | AIR PRESSURE PSIA | EXT'N TEMP °F | RATIO: PENTANE/ 30 WT% DEA | CATALYST |
|---|---|---|---|---|
| ○ | NONE | 125 | 5/1 | NONE |
| ▲ | 15 | 75 | 5/1 | NONE |
| □ | 15 | 125 | 5/1 | NONE |
| ■ | 15 | 125 | 5/1 | NONE |
| △ | 30 | 125 | 5/1 | NONE |
| × | 30 | 125 | 5/1 | 0.073 GM Co 100 ML/30 WT% DEA |

USE OF ALKANOLAMINES IN SWEETENING SOUR LIQUID HYDROCARBON STREAMS

FIELD OF THE INVENTION

The present invention relates to the conversion of mercaptans present in sour distillates or other hydrocarbon streams into their corresponding disulfides.

BACKGROUND OF THE INVENTION

The purpose of hydrocarbon liquid treating is for removal or chemical conversion of objectionable compounds or elemental sulfur in order that the liquid products meet corrosion, doctor, and total sulfur content specifications. Failure of a hydrocarbon product to meet corrosion specifications can be due to the presence of hydrogen sulfide and/or free sulfur. Failure to pass a doctor test is caused by the presence of mercaptans. Off-specification products are commonly referred to as "corrosive" if a positive corrosion test is obtained or "sour" if a positive doctor test results; sometimes the liquid product is both "corrosive" and "sour".

It is noted that the use of the term "sour" differs as applied to liquids and gases. "Sour" or "doctor sour" as applied to liquid hydrocarbon products indicates the presence of mercaptans, whereas "sour" used in connection with gaseous hydrocarbon products indicates the presence of hydrogen sulfide. If a liquid hydrocarbon product is negative to the doctor test, it is called "sweet" or "doctor sweet". If a negative corrosion test results, the liquid product is called "noncorrosive". It should be noted that a sweet or doctor sweet liquid hydrocarbon product can result from mere conversion of mercaptans to sulfides or disulfides even though the total sulfur content remains the same or is even higher in some methods.

Removal of hydrogen sulfide and/or free sulfur is desired to prevent corrosion or plugging of users equipment, such as carburetor parts, needle valves, etc. Removal or chemical conversion of mercaptans is desired to eliminate the offensive odor of mercaptans. However, processes that actually remove the mercaptans or their conversion products yield a superior product because of improved tetraethyl lead susceptibility and elimination of sulfur oxides from the products of combustion.

For many years liquid hydrocarbon streams of the type which can be treated in accordance with the present invention have been sweetened by subjecting them to oxidizing conditions in a sodium hydroxide or potassium hydroxide solution, generally in the presence of agitation and a metal phthalocyanine catalyst or equivalent. The mercaptans are converted to the corresponding disulfides at the interface of the aqueous caustic solution and the liquid hydrocarbons with the resulting disulfides dissolving in the liquid hydrocarbon.

The sweetening process has also been carried out in fixed bed systems in the presence of a catalyst and an oxidizing agent. The hydrocarbon stream to be treated can be passed in contact with an aqueous caustic solution over a solid, usually supported, catalyst in a suitable treating vessel. The caustic solution can be regenerated or supplemented as it becomes spent as the result of accumulation of acidic and other nonhydrocarbon impurities. The catalyst, when necessary, can be reactivated by means of well-known in-place regeneration procedures.

One widely known industrial method for treating mercaptan-containing hydrocarbon streams is the Merox Process. See, for example, the *Oil and Gas Journal* - 57 (44), 73–78 (1959) which has a discussion of the Merox Process and other prior art procedures. Like other known sweetening processes it uses a catalyst to oxidize the mercaptans to disulfides in the presence of oxygen and caustic.

SUMMARY OF THE INVENTION

According to the invention, a liquid hydrocarbon stream containing mercaptans is treated by contacting the liquid hydrocarbon stream with an alkanolamine under oxidizing conditions to convert at least a portion of the mercaptans into their corresponding disulfides.

According to one aspect of the invention, the liquid hydrocarbon stream is contacted with the alkanolamine in the absence of an inorganic alkaline substance.

DESCRIPTION OF THE INVENTION

Figure 1:
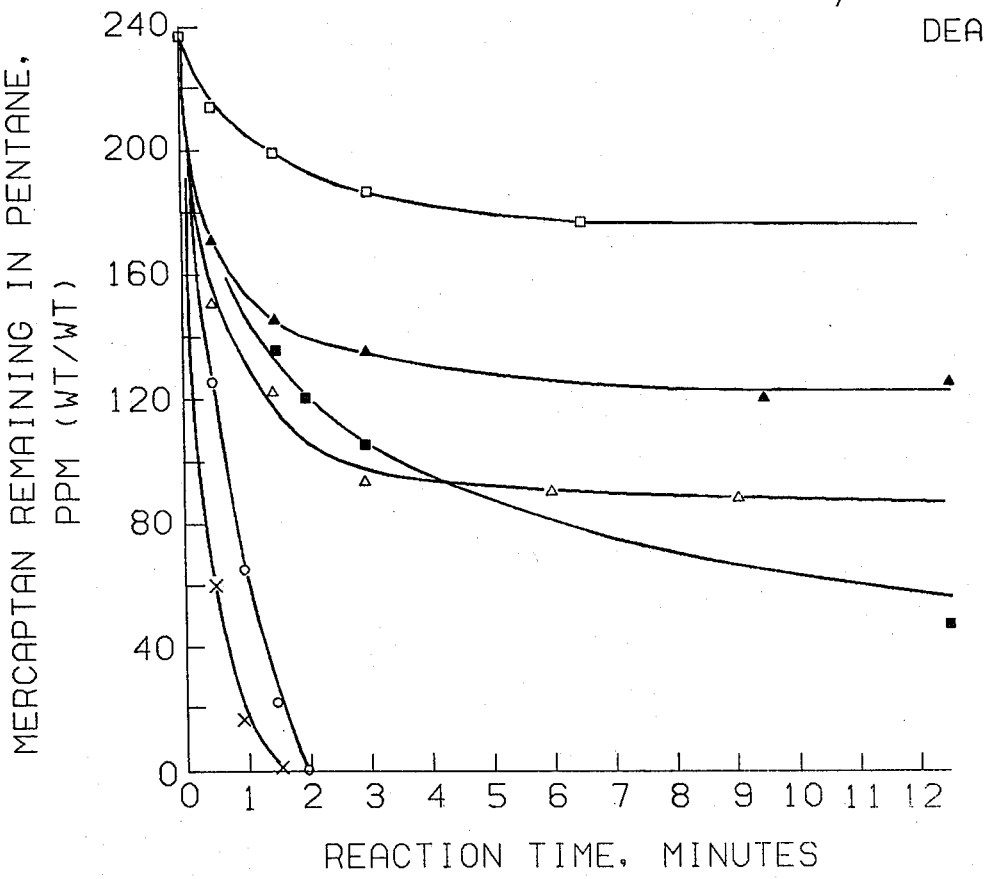
FIGS. 1 and 2 show the effect of various operating conditions on the rate and extent of conversion of methyl mercaptan and ethyl mercaptan, respectively, to the corresponding disulfides.

The process of our invention can be applied to a wide variety of hydrocarbon streams contaminated with mercaptans. However, it can be particularly useful in the sweetening of such streams contaminated with methyl mercaptan or ethyl mercaptan. Examples of such streams include straight run gasoline, natural gas liquids (NGL), cracked gasolines, and the like.

In carrying out our invention, a liquid hydrocarbon stream containing undesired mercaptans (sour liquid hydrocarbons) can be preferably introduced at the bottom of a stirred reaction vessel along with a controlled volume (preferably a slight excess) of an oxygen containing gas such as, for example, air or oxygen enriched air. Countercurrent to the resulting rising oxygenated mixture of sour liquid hydrocarbons can be introduced a stream of suitable alkanolamine. Depending upon the composition of the sour liquid hydrocarbons and the alkanolamine employed, the operating conditions should be carefully selected. A catalyst such as, for example, cobalt phthalocyanine can be preferably used if a relatively fast reaction rate is desired. When the mercaptans are converted in the presence of alkanolamine and oxygen into disulfides, the latter tend to dissolve in the liquid hydrocarbons, that is, the disulfides are hydrocarbon soluble. The rich aqueous alkanolamine solution is removed from a level near the base of the contactor and sent to a regenerating unit for treatment and reuse. Unlike other processes, according to the invention, there need be no alkaline inorganic substance or caustic present in the conversion medium employed.

While most any of the well-known water soluble alkanolamines can be used in our process, monoethanolamine is not preferred for treatment of streams containing COS (carbonyl sulfide) and/or $CS_2$ (carbon disulfide) since it tends to form compounds with such substances from which the monoethanolamine is not regenerable. If COS and/or $CS_2$ are not present, monoethanolamine can be used. However, in most cases, we prefer to employ diethanolamine because it is more resistant to oxidation then monoethanolamine or other primary amines. This alkanolamine not only can be regenerated from the compounds it forms with CShd 2 and COS, but in most such treating systems used in natural gasoline plants, diethanolamine or an equivalent alkanolamine is employed to remove $H_2S$ and $CO_2$ from the raw gas as it enters the plant. By the use of the same alkanolamine(s) in both the initial removal of $H_2S$ and $CO_2$ and in the subsequent sweetening step for conversion of mercaptans and removal of COS and $CS_2$, the use of caustic can be completely avoided and with it the necessity of additional equipment for regeneration of the caustic solution. In the process, the alkanolamine employed can form a loose salt—a mercaptide—with the portion of the mercaptan that is not oxidized to the disulfide. This salt which is soluble in the aqueous alkanolamine solution can be withdrawn in solution from the contactor and the alkanolamine liberated and recovered in a regeneration step.

Other operating conditions influential in the process include temperature, pressure, the ratio of hydrocarbon solution to aqueous alkanolamine, and the like. Briefly, operating temperatures may range from about 60° F. to about 150° F., preferably in the range of 120° F. to about 130° F. To some extent, the temperature used may depend on the pressure employed. Pressures may range from about 20 psia to 300 psia preferably 30 psia to 100 psia, and can be very influential on the rate and completeness of the conversion of the mercaptans to the disulfides, as will be subsequently shown in more detail. The ratio of hydrocarbon solution to aqueous alkanolamine can vary widely, typically from about 1:1 to about 10:1 preferably, for example, about 5:1. The aqueous alkanolamine generally may contain from about 5 wt % to about 70 wt % alkanolamine depending in part on the alkanolamine.

In most instances, the use of an oxidation catalyst can be beneficial but is not necessarily essential, depending in general on the extent of the conversion to the disulfides desired. Such catalysts are well-known and generally include metal salts of the iron group of the Periodic Table (Group VIII). The employed concentration of such catalysts may lie in the range normally used for such purposes. However, we usually prefer to use an amount between about 0.01 and 0.1 gram/100 ml of alkanolamine solution employed, calculated as the free metal.

DETAILED DESCRIPTION OF THE DRAWINGS

Figure 2:
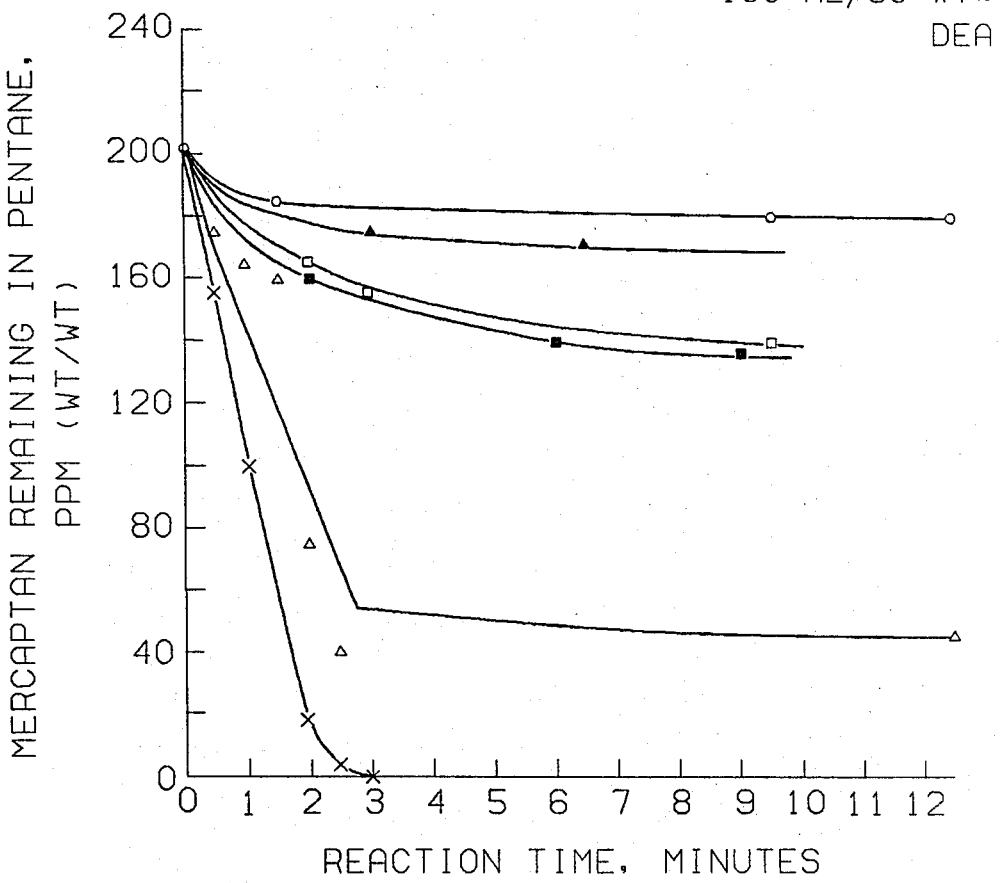

The process of our invention and the results obtained therefrom are further illustrated by the accompanying drawings in which FIGS. 1 and 2 are plots showing the effect of various operating conditions on the rate and extent of conversion of methyl mercaptan and ethyl mercaptan, respectively, to their corresponding disulfides. Conversion of mercaptans is indirectly shown in these figures in terms of mercaptan remaining in a pentane solution originally containing 230 ppm of the mercaptan.

Figure 3:
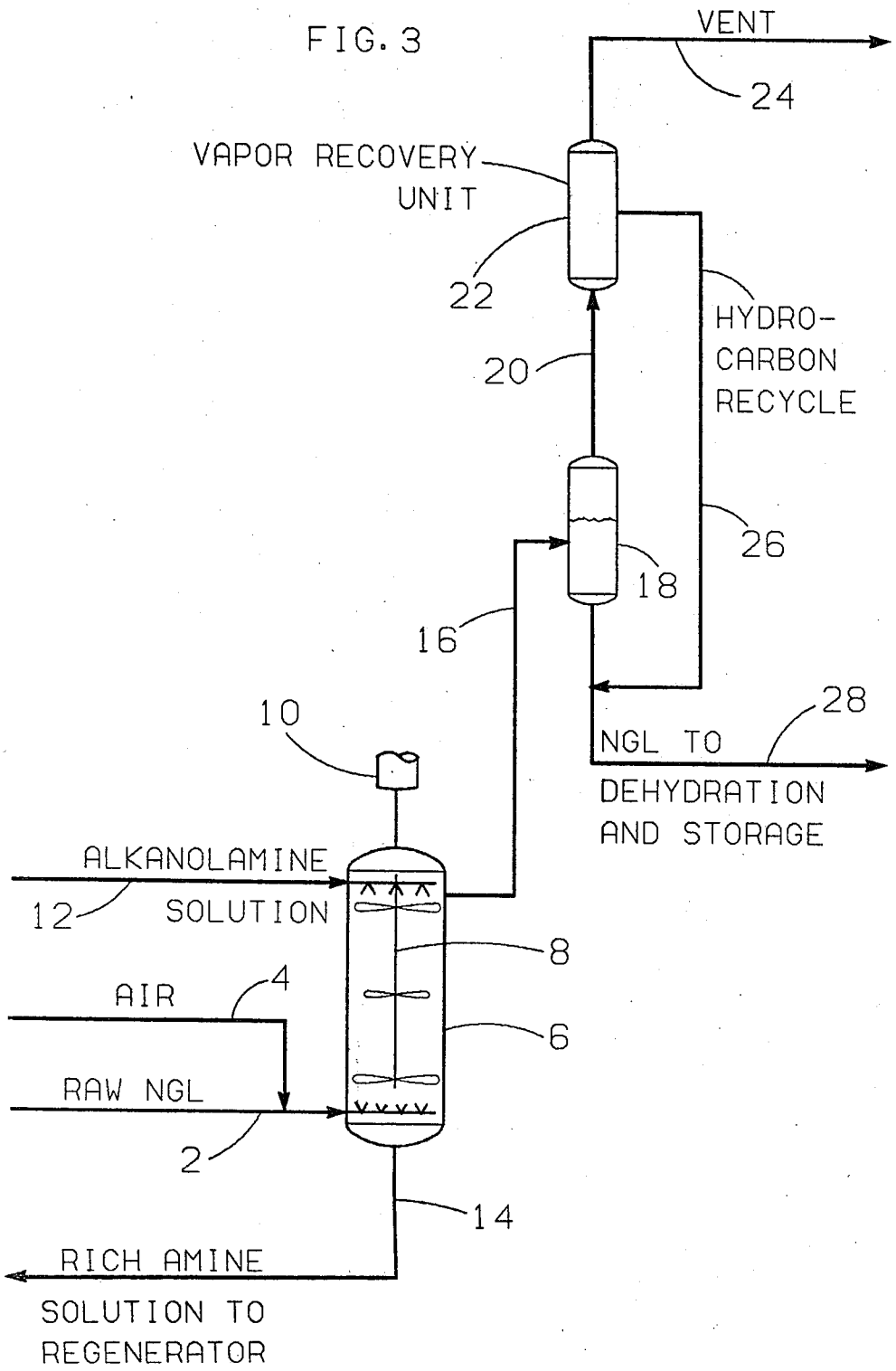
FIG. 3 is a flow diagram illustrating the method according to the invention.

FIG. 3 is a flow diagram illustrating one form of equipment that can be used in this process and typical materials used under the conditions taught herein.

Referring now to FIG. 1, a quantity of pentane containing 230 ppm of methyl mercaptan is subjected to the illustrated conditions of temperature, pressure, diethanolamine concentration, and ratio of pentane to diethanolamine. The cobalt catalyst used in the last entry of the Table of FIG. 1 is cobalt acetylacetonate. The concentration of cobalt listed in the Table (in both FIGS. 1 and 2) is calculated as the metal but is added as the organic salt. An inspection of the curves in FIG. 1 shows the results to be quite sensitive to pressure and, in the case of methyl mercaptan—at least at the concentrations present—relatively insensitive to the use of the cobalt catalyst at 30 psia. Thus, in the last two runs shown in the Table of FIG. 1, it will be seen—from the corresponding curves—that methyl mercaptan can be substantially and completely removed, i.e., converted to dimethyl disulfide, in the presence or absence of an oxidation catalyst within a reaction time not exceeding two minutes.

In FIG. 2, the effect of pressure on the system is similar to that shown in FIG. 1; however, the significance of a catalyst is demonstrated in the case of converting ethyl mercaptan to the corresponding disulfide if substantially complete conversion of ethyl mercaptans is desired.

Referring now to FIG. 3, the process of the present invention is illustrated as a simplified flow diagram with reference to pumps, valves, compressors, and other auxiliary equipment being omitted. Exemplary compositions, temperatures, and flow rates are provided below to illustrate the invention but not to limit its scope. Referring now to FIG. 3, raw NGL are pumped through line 2 at a rate of 10,000 bbls/day and mixed with air flowing through line 4 at 880 lbs/day. The raw NGL contain 200 ppm of mercaptans having an average molecular weight of 55. The resulting mixture of air and NGL is then introduced into contactor 6, for example, a stirred vessel, operated at about 30 psia and the contents agitated by stirrer 8 powered by electric motor 10. At the top of contactor 6, a 30 wt % aqueous solution of diethanolamine is introduced through line 12 at a rate of 2000 bbls/day. The fluids within contactor 6 are thoroughly mixed at about 125° F. allowing oxidation of the mercaptan therein and forming the corresponding disulfides. The latter remain in the hydrocarbon phase while unconverted mercaptans form an ammonium salt with the alkanolamine, dissolve in the aqueous phase and are removed from the contactor via line 14.

The contacted hydrocarbon phase emerges from the top of the contactor through line 16, passes to separator 18 where water vapor, air and some hydrocarbon vapors are removed therefrom through line 20 and sent to vapor recovery unit 22 where uncondensed material is withdrawn by line 24 and residual hydrocabon product is taken off through line 26 and combined with sweetened NGL in line 28 flowing from separator 10.

From the foregoing description, it will be seen that the process of our invention has a number of advantages over procedures currently in use including: The use of the same alkanolamine reagent to remove acidic components from the raw natural gas fed to the plant as is employed in sweetening the NGL. This procedure also obviates the need for the use of alkaline inorganic substance caustic in the sweetening step and the expense of additional and separate equipment for regeneration of the caustic.

What we claim is:

1. A method for sweetening a liquid hydrocarbon stream containing mercaptans by converting the latter into their corresponding hydrocarbon soluble disulfides, which consists essentially of contacting said liquid hydrocarbon stream with an agent and an oxygen containing gas under effective oxidizing conditions, and wherein the agent consists essentially of an alkanolamine.

2. A method for sweetening a liquid hydrocarbon stream free of COS and/or $CS_2$ containing methyl mercaptan by converting the latter into a corresponding hydrocarbon soluble disulfide, which consists essentially of contacting said liquid hydrocarbon stream with an agent and an oxygen containing gas under effective oxidizing conditions, and wherein the agent consists essentially of an alkanolamine.

3. The method of claim 2 in which monoethanolamine is employed as a principal alkaline agent for oxidizing mercaptans to disulfides.

4. The method of claim 1 in which diethanolamine is employed as a principal alkaline agent for oxidizing mercaptans to disulfides.

5. The method of claim 1 in which the liquid hydrocarbon stream consists principally of unsweetened NGL.

6. The method of claim 1 in which the oxidizing conditions include carrying out the contacting at elevated pressure.

7. The method of claim 1 wherein the stream is contacted with an alkanolamine in the absence of an alkaline inorganic substance.

* * * * *